US006161566A

United States Patent [19]

Klamm

[11] Patent Number: 6,161,566

[45] Date of Patent: Dec. 19, 2000

[54] TOOL AND METHOD FOR DRAINING AND RECOVERING COOLANT FROM A MOTOR VEHICLE COOLING SYSTEM

[75] Inventor: Thomas L. Klamm, Racine, Wis.

[73] Assignee: UView Ultraviolet Systems, Inc., Mississauga, Canada

[21] Appl. No.: 09/082,254

[22] Filed: May 20, 1998

[51] Int. Cl.[7] ..... F01P 11/02

[52] U.S. Cl. ..... 137/317; 137/205; 123/41.14; 141/65

[58] Field of Search ..... 137/317, 318, 137/205; 161/65, 98, 330; 123/41.4, 41.15

[56] References Cited

U.S. PATENT DOCUMENTS 289,075 11/1883 Davey ..... 137/317 X
498,357 5/1893 Mehring ..... 137/317
4,782,689 11/1988 DeRome ..... 73/49.2
4,888,980 12/1989 DeRome ..... 73/49.2

OTHER PUBLICATIONS

D. Cappert, "Let it Bleed", *Super Automotive Service,* pp. 22–25, Oct. 1989.

E. Carpenter, "Vac–U–Fill Coolant Filler", *Circle Track,* pp. 132–133, Feb. 1997.

*Primary Examiner*—John Rivell
*Attorney, Agent, or Firm*—Bell, Boyd & Lloyd LLC

[57] ABSTRACT

A coolant draining tool has a thermally insulating handle with a passageway therethrough. A curved drain tube is connected to the passageway and has an end portion with plurality of apertures for insertion into the cooling system of a motor vehicle. A hose coupling also is connected to the passageway for attaching the tool to a suction device to draw coolant from the cooling system.

13 Claims, 1 Drawing Sheet

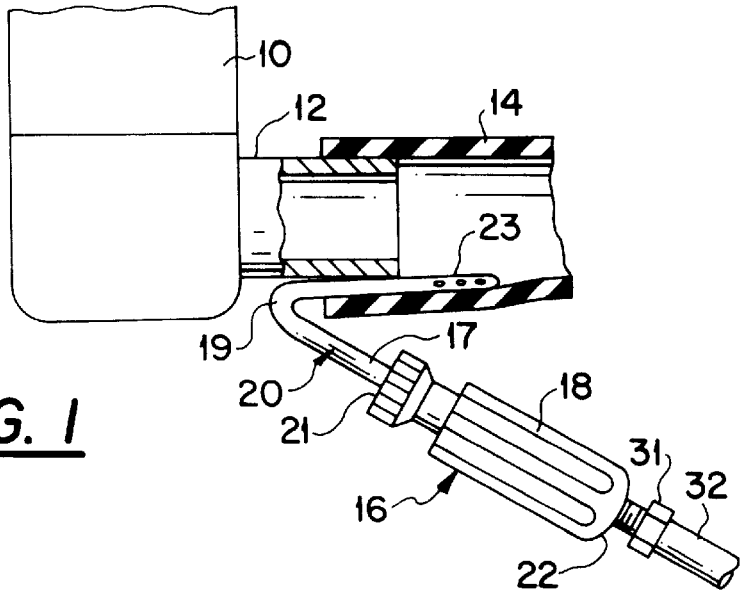
FIG. 1
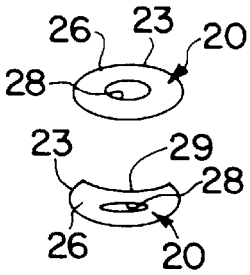
FIG. 3
FIG. 4
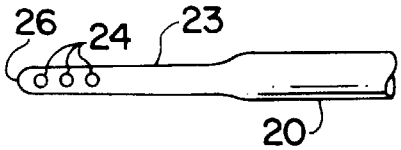
FIG. 2
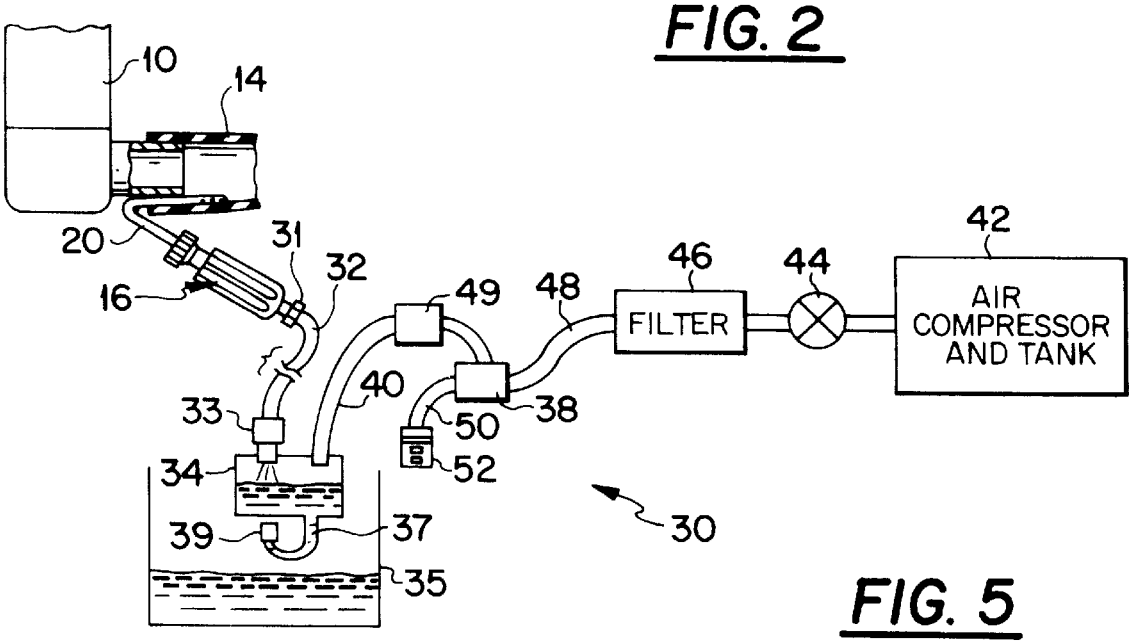
FIG. 5

TOOL AND METHOD FOR DRAINING AND RECOVERING COOLANT FROM A MOTOR VEHICLE COOLING SYSTEM

BACKGROUND OF THE INVENTION

The present invention relates to equipment for servicing cooling systems of motor vehicles; and specifically to tools for draining and recovering the coolant for environmentally conscious disposal or recycling.

Periodically, it is necessary to replace the coolant in the cooling system for a motor vehicle engine. For this purpose, a stopcock is provided at the bottom of the radiator. In order to drain the system, the stopcock is opened and a cap at the top of the radiator is removed to allow air to enter the system, braking a vacuum which would otherwise prevent the flow of coolant through the lower stopcock. For faster draining, the technician often cuts the lower radiator hose when that hose was to be replaced as part of the cooling system maintenance.

For years service technicians simply allowed the coolant to flow to a floor drain in the garage from which it entered the municipal sewer system. With increased concerns about harming the environment, such dumping of coolant, which often contains heavy metals, into a sewer system has been prohibited. Now the service technician must place a pan beneath the stopcock to catch the coolant draining from the engine and then pour the coolant into a suitable container for proper disposal according to environmental protection regulations.

The coolant drains relatively slowly from the cooling system and in fact may not drain by gravity from all of the locations within the engine block. It is therefore desirable to provide a faster technique for removing the coolant from the cooling system of a motor vehicle and recovering the drained coolant for proper disposal.

SUMMARY OF THE INVENTION

The general object of the present invention is to provide a tool for rapidly draining coolant from a motor vehicle and recovering the coolant for proper disposal.

Another object is to provide a tool which would enable the elimination of the drain stopcock on the radiator.

These and other objectives are satisfied by a coolant draining tool which preferably includes a handle having a passageway therethrough. A drain tube is connected to the passageway and has an end portion for insertion into the cooling system. That end portion has at least one aperture for coolant to enter the drain tube. Preferably the end portion is flattened slightly to assume an elongated cross section, such as a oval, which aids insertion of the drain tube into the motor vehicle cooling system. A conduit is connected to the passageway.

In use, the tip of the drain tube end portion is forced between a radiator hose and a hose coupling of the cooling system. The drain tube is inserted far enough so that the aperture in the end portion is exposed within the hose thereby enabling coolant to enter the drain tube. The conduit attached to the tool is connected to a suction device which draws the coolant from the cooling system into a container for disposal or recycling.

BRIEF DESCRIPTION OF THE DRAWINGS

FIG. 1 illustrates a tool, according to the present invention, inserted into a radiator hose of a motor vehicle;

FIG. 2 is a detailed view of a tip of the tool;

FIG. 3 is an end view of the tip of the tool;

FIG. 4 is an end view of an alternative tip of the tool; and

FIG. 5 depicts a system which utilizes the tool for draining and recovering the coolant from the motor vehicle.

DETAILED DESCRIPTION OF THE INVENTION

With initial reference to FIG. 1, a hose coupling 12 projects from a bottom section of a motor vehicle radiator 10. A rubber hose 14 extends over the coupling and leads to the engine block (not shown). Usually a band-type hose clamp encircles the hose 14 and coupling 12 to secure those components together in a water-tight manner. That clamp has been removed, or at least loosened significantly, in order to drain the coolant from the engine cooling system. However, the rubber hose 14 likely has bonded over time to the radiator coupling 12, so that in an unpressurized system the coolant does not leak out the loosened connection.

After removal of the lower hose clamp, the service technician inserts a drain tool 16 between the hose and radiator coupling. The tool 16 has a tubular handle 18 made of thermal insulating material, such as plastic, for gripping by the service technician. For example, the handle may resemble that of a screwdriver. A passageway extends lengthwise through the handle 18 from opposite ends 21 and 22.

A curved drain tube 20 has a portion 17 inserted in the passageway opening at handle end 21 and is secured therein. For example, the drain tube 20 may be threaded into the handle or attached by a standard compression fitting. Alternatively, the handle may be molded directly to the drain tube. The drain tube 20 is bent to have longitudinal curved portion 19, with a V-shape being preferred, although other shapes may be employed including a straight tube. The drain tube 20 has a circular cross-section which is flattened slightly to have an elongated cross section, such as an oval shape, at an end portion 23 that is remote from the handle 18, as seen in greater detail in FIGS. 2 and 5. The flattened end portion 23 may have a concavo-convex cross section as shown in FIG. 4 to provide a surface 29 which conforms to the curved outer surface of the radiator coupling 12. The shape of the drain tube end portion 23 allows it to be slid between the hose and the radiator coupling. Even though flattened, end portion 23 still is hollow so that coolant is able to flow therethrough, as will be described. A plurality of apertures 24 extend transversely through the end portion 23 of the drain tube 20 and the tip 26 also has an aperture 28.

With reference to FIG. 3, the tool 16 is connected to a system 30 for draining and recovering the coolant from the motor vehicle. The coolant recovery system 30 comprises an inlet hose 32 which attaches to a fitting 31 inserted into the passageway at the second end 23 of the tool handle 16 (see also FIG. 1). The inlet hose 32 is connected to a sealed vacuum chamber 34 which has a filter 33 to remove any heavy metals that may be present in the coolant. Alternatively, the passageway may be formed by a tube inserted through a handle body with couplings at each end of the tube for connection to the drain tube 20 and the inlet hose 32.

Coolant from the lower radiator hose 14 flows into the vacuum chamber 34 which is within a larger open reservoir 35, such as a standard 55 gallon drum for example. A U-shaped drain pipe 37 extends from the bottom of the vacuum chamber 34 and terminates within the reservoir 35 at a drain check valve 39. The drain check valve 39 closes the opening to the drain pipe 37 so that air from the open reservoir 35 can not enter the vacuum chamber 34.

The coolant is drawn from the lower radiator hose 14 into the vacuum chamber 34 due to suction produced by a venturi assembly 38. Specifically a suction hose 40 with an in-line suction check valve 49 extends from the upper portion of the vacuum chamber 34 to the venturi assembly 38. The exhaust hose 50 extends from the outlet of the venturi assembly 38 and terminates at a muffler 52 which reduces sound produced by the exhaust air.

The inlet of the venturi assembly 38 is supplied with compressed air from a source 42, such as an air compressor and tank assembly commonly found in most motor vehicle service facilities for powering pneumatic tools. Although compressed air is used in the preferred embodiment, because it is readily available at most facilities, sources of other pressurized gases and liquids also could be used to create a partial vacuum in the venturi assembly 38. An outlet of compressed air source 42 is connected through a control valve 44 and an air filter 46 that removes particles from the air flow which could adversely affect the operation of the venturi assembly 38. A hose 48 couples the filter 46 to the inlet of the venturi assembly 38.

One skilled in the art will appreciate that the present inventive concept also may be carried out by replacing the venturi assembly 38, muffler 52 and components 42–48 that act as a source of compressed air, with a pump that creates a partial vacuum in the sealed vacuum chamber 34.

For example, to drain the coolant from a vehicle, a service technician removes the clamp from the lower radiator hose 14 and inserts the tip 26 of the drain tool 16 between that hose and the radiator coupling 12 until the tip extends into the hose beyond the coupling. Other hose connections of the cooling system also may be used. The relatively thin, flattened end portion 23 enables the tip of the tool's drain tube 20 to be worked into the hose 14. The technician also removes the filler cap (not shown) at the top of the radiator 10 to allow air to enter during the draining process.

The technician opens the control valve 44 so that compressed air from source 42 flows through the venturi assembly 38. The air flow creates a negative pressure (less than atmospheric pressure) in the venturi assembly 38 which draws air from the vacuum chamber 34 through hose 40. This creates a partial vacuum in chamber 34 which draws coolant into the tool 16 from the lower radiator hose 14. If there is a gap between the end portion 23 of the tool 16 and either the radiator coupling 12 or hose 14, the suction provided in the vicinity of that end portion will tend to draw air through that gap thus preventing coolant from leaking out.

The flow of coolant into the vacuum chamber 34 continues until fluid level reaches the open end of the suction hose 40, which causes the suction check valve 49 to close terminating the suction provided by the venturi assembly 38. With the suction removed, the drain check valve 49 opens under the force of the coolant in the drain pipe 37, thereby allowing the coolant to flow into the reservoir 35. The coolant drains into the reservoir 35 until its level within the vacuum chamber 34 drops below the open end of the suction hose 40. At that time, the check valve 49 opens again applying suction to the vacuum chamber 34 which causes the drain check valve 39 to close. This process repeats until all the coolant has been extracted from the radiator hose 20 at which point only air flows into the vacuum chamber 34.

The drain and recovery system 30 removes coolant from the motor vehicle cooling system at a faster rate than previous techniques that relied solely on gravity flow. The tool 16 enables quick, leak-proof attachment of a drain hose to the cooling system. In addition, the vacuum chamber 34 and reservoir 35 do not have to be lower than the radiator hose 20 to properly drain coolant from the engine cooling system. When the reservoir 35 becomes filled with coolant after repeated use, it is sealed and sent to a coolant disposal or recycling facility.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A tool for draining coolant from a cooling system of a motor vehicle, said tool comprising:

a drain tube having an end portion with an elongated cross section for insertion into the cooling system, the end portion having at least one aperture for coolant to enter the drain tube and a tip on an end of the end portion, the tip having at least one additional aperture for coolant to enter the drain tube, wherein the end portion is flattened to assume an oval cross section which aids insertion of the drain tube into the motor vehicle cooling system; and a coupling attached to the drain tube for connecting to a conduit.

2. The apparatus as recited in claim 1 wherein the end portion of the drain tube has a plurality of apertures.

3. The apparatus as recited in claim 1 further comprising a handle having a passageway with first and second openings, wherein the drain tube is connected to the passageway at the first opening and the coupling is connected to the second opening.

4. The apparatus as recited in claim 3 wherein the handle is made of a thermal insulating material.

5. The apparatus as recited in claim 1 wherein the drain tube has a longitudinal curved shape.

6. The apparatus as recited in claim 1 wherein the drain tube has a longitudinal V shape.

7. A tool for draining coolant from a cooling system of a motor vehicle, said tool comprising:

a handle having a passageway therethrough;

a drain tube connected to the passageway and having an end portion for insertion into the cooling system, the end portion having at least one aperture for coolant to enter the drain tube and a tip on an end of the end portion, the tip having at least one additional aperture for coolant to enter the drain tube, wherein the end portion is flattened to assume an oval cross section which aids insertion of the drain tube into the motor vehicle cooling system; and a conduit connected to the passageway.

8. The apparatus as recited in claim 7 wherein the end portion of the drain tube has a plurality of apertures.

9. The apparatus as recited in claim 7 wherein the handle is made of a thermal insulating material.

10. The apparatus as recited in claim 7 wherein the drain tube further comprises a handle portion connected to the passageway; and a curved portion between the handle portion and the end portion.

11. The apparatus as recited in claim 10, wherein the handle portion, curved portion and end portion form a V shape.

12. A method for draining coolant from a cooling system of a vehicle, said method comprising:

providing a drain tube which has an end portion with at least one aperture for coolant to enter the drain tube;

connecting the drain tube via a coupling to a conduit which leads to a container;

inserting the end portion of a drain tube into a hose of the cooling system, wherein inserting comprises inserting the end portion of the drain tube between the hose of the cooling system and a hose coupling of the cooling system; and opening a cap on the radiator while allowing the coolant to flow through the drain tube into the container.

13. A tool for draining coolant from a cooling system of a motor vehicle, said tool comprising:

a drain tube having an end portion with an elongated cross section for insertion into the cooling system, the end portion having at least one aperture for coolant to enter the drain tube and a tip on an end of the end portion, the tip having at least one additional aperture for coolant to enter the drain tube, wherein the end portion has a concavo-convex cross section shape which aids insertion of the drain tube into the motor vehicle cooling system; and a coupling attached to the drain tube for connecting to a conduit.

* * * * *